US006507346B1

(12) United States Patent
Otera

(10) Patent No.: US 6,507,346 B1
(45) Date of Patent: Jan. 14, 2003

(54) IMAGE PROCESSING METHOD AND IMAGE DISPLAY

(75) Inventor: Atsushi Otera, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/445,743

(22) PCT Filed: Apr. 6, 1999

(86) PCT No.: PCT/JP99/01830

§ 371 (c)(1),
(2), (4) Date: Feb. 2, 2000

(87) PCT Pub. No.: WO99/53473

PCT Pub. Date: Oct. 21, 1999

(30) Foreign Application Priority Data

Apr. 10, 1998 (JP) ..... 10-116163

(51) Int. Cl.[7] ..... G09G 5/00
(52) U.S. Cl. ..... 345/606; 345/660
(58) Field of Search ..... 345/660, 60–64, 345/48, 38, 11, 3.2, 3.1, 606, 612, 613, 614, 50, 87; 348/448, 226, 222, 223; 358/166; 356/48; 359/229; 352/201

(56) References Cited

U.S. PATENT DOCUMENTS 5,091,784 A * 2/1992 Someya et al. ..... 358/183
5,231,497 A * 7/1993 Mizuta ..... 358/166
5,521,636 A * 5/1996 Nakayama et al. ..... 348/222
5,561,517 A * 10/1996 Horiuchi et al. ..... 356/39
5,978,041 A * 11/1999 Masuda et al. ..... 348/563
6,266,983 B1 * 7/2001 Takada et al. ..... 72/11.1
6,288,745 B1 * 9/2001 Okuno et al. ..... 348/448

FOREIGN PATENT DOCUMENTS

| | | |
|---|---|---|
| JP | A-4-339480 | 11/1992 |
| JP | A-5-304654 | 11/1993 |
| JP | A-8-123358 | 5/1996 |
| JP | A-8-335062 | 12/1996 |

* cited by examiner

*Primary Examiner*—Matthew Luu
*Assistant Examiner*—Thu-Thao Havan
(74) *Attorney, Agent, or Firm*—Oliff & Berridge, PLC

(57) ABSTRACT

The invention concerns the occurrence of flicker being reduced when an interlaced image signal is converted into a non-interlaced signal and displayed at a desired magnification. Correction coefficients corresponding to the respective even-numbered fields and odd-numbered fields are determined according to the magnification of an image and stored in an ODD coefficient memory and an EVEN coefficient memory. For each process for outputting image data corresponding to each pixel in each line of a liquid-crystal display panel, a corresponding correction coefficient is read from the ODD coefficient memory or the EVEN coefficient memory and provided to an interpolation processing circuit. The interpolation processing circuit interpolates image data of one pixel from image data of four pixels read from a line memory. The correction coefficient is set in such a way that pixel data at the same pixel position within the original image is provided to the same pixel of the liquid-crystal panel in either the even-numbered fields or the odd-numbered fields.

16 Claims, 14 Drawing Sheets

$$P(y,x)=[ky\ \ 1-ky]\begin{bmatrix} P(i,j) & P(i,j+1) \\ P(i+2,j) & P(i+2,j+1)\end{bmatrix}\begin{bmatrix} kx \\ 1-kx\end{bmatrix}$$

$$=\underbrace{ky\cdot kx}_{K00}\cdot P(i,j)+\underbrace{ky\cdot(1-kx)}_{K01}\cdot P(i,j+1)$$

$$+\underbrace{(1-ky)\cdot kx}_{K10}\cdot P(i+2,j)+\underbrace{(1-ky)\cdot(1-kx)}_{K11}\cdot P(i+2,j+1)$$

[Fig. 1]
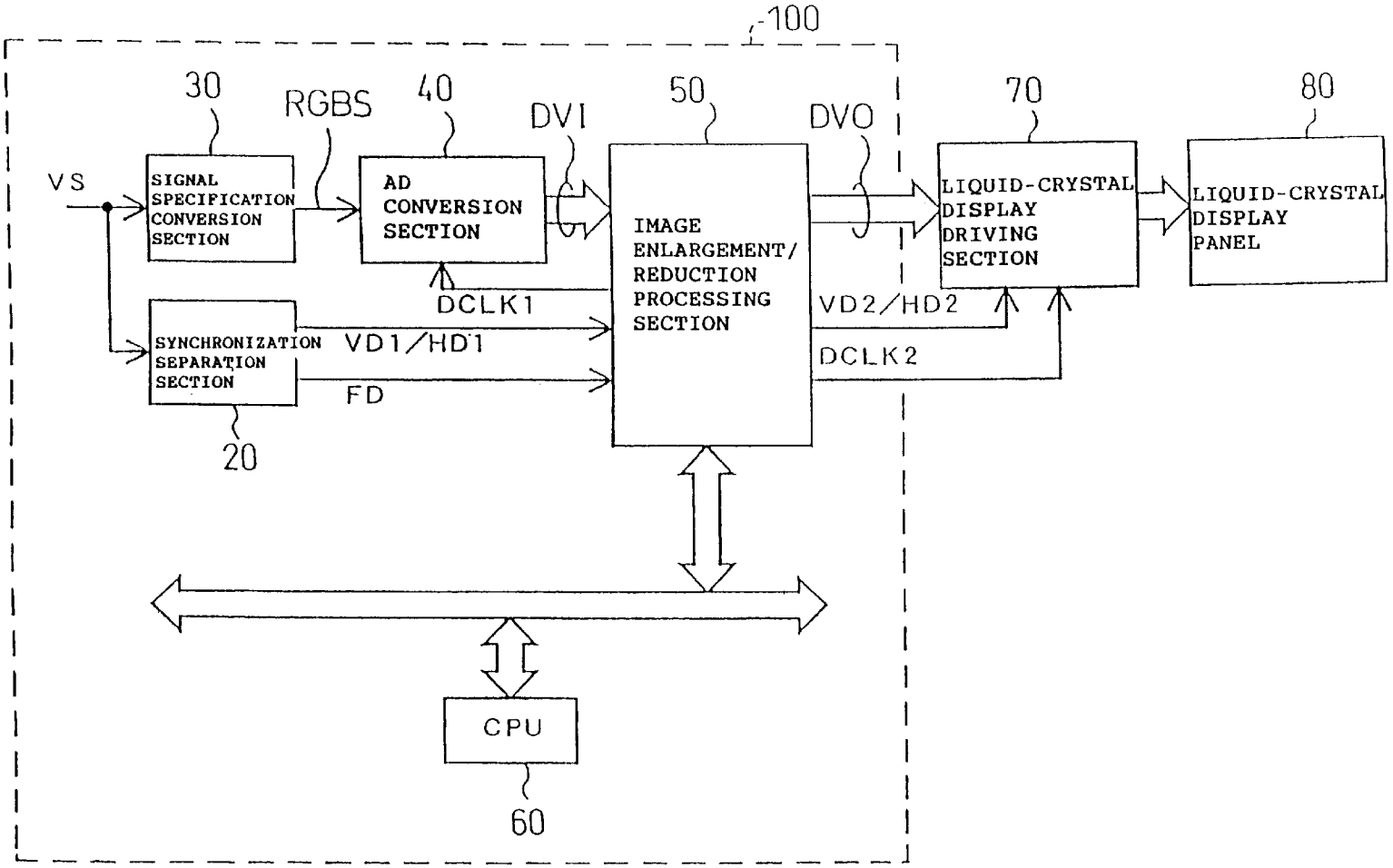

[Fig. 2]
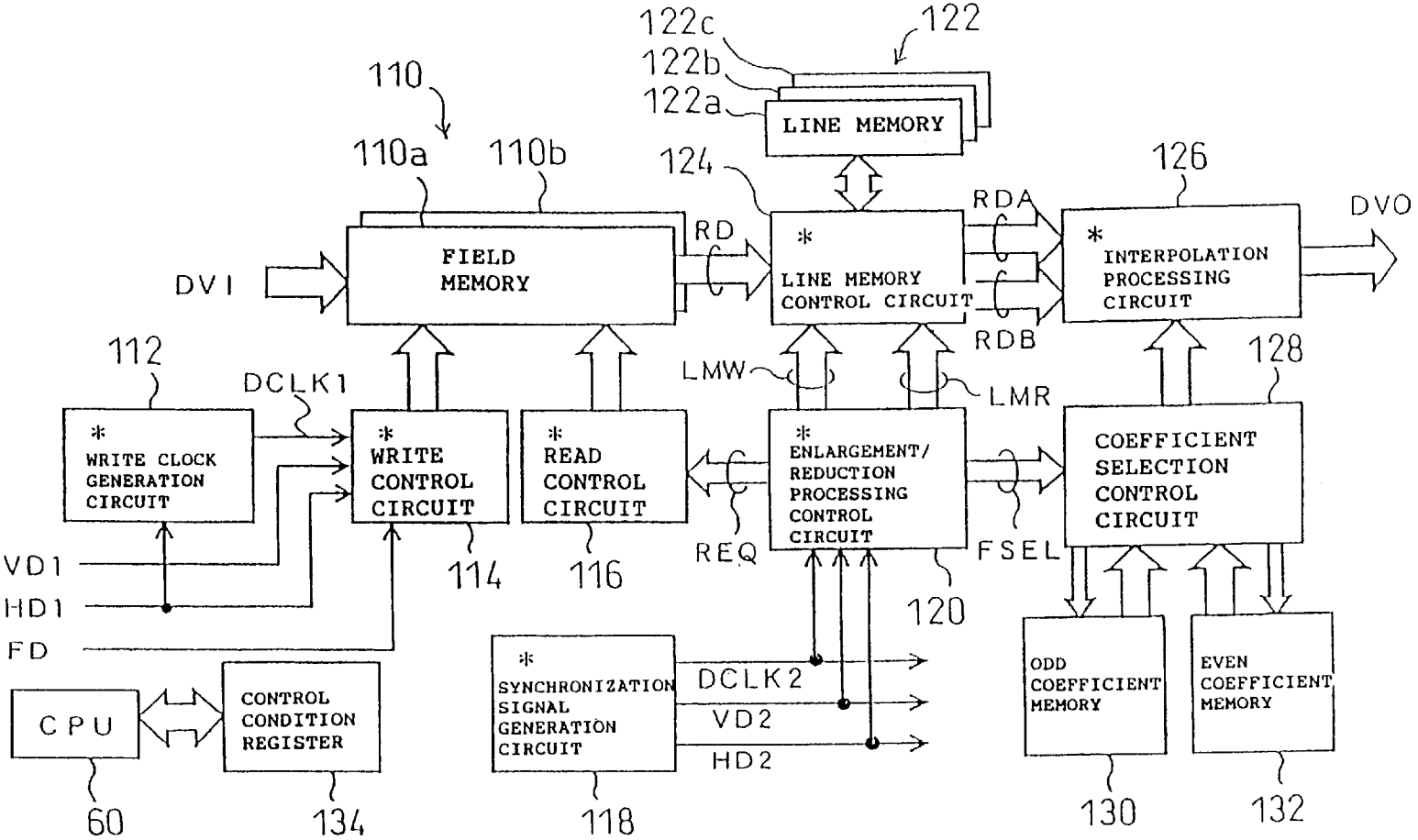

[Fig. 3]
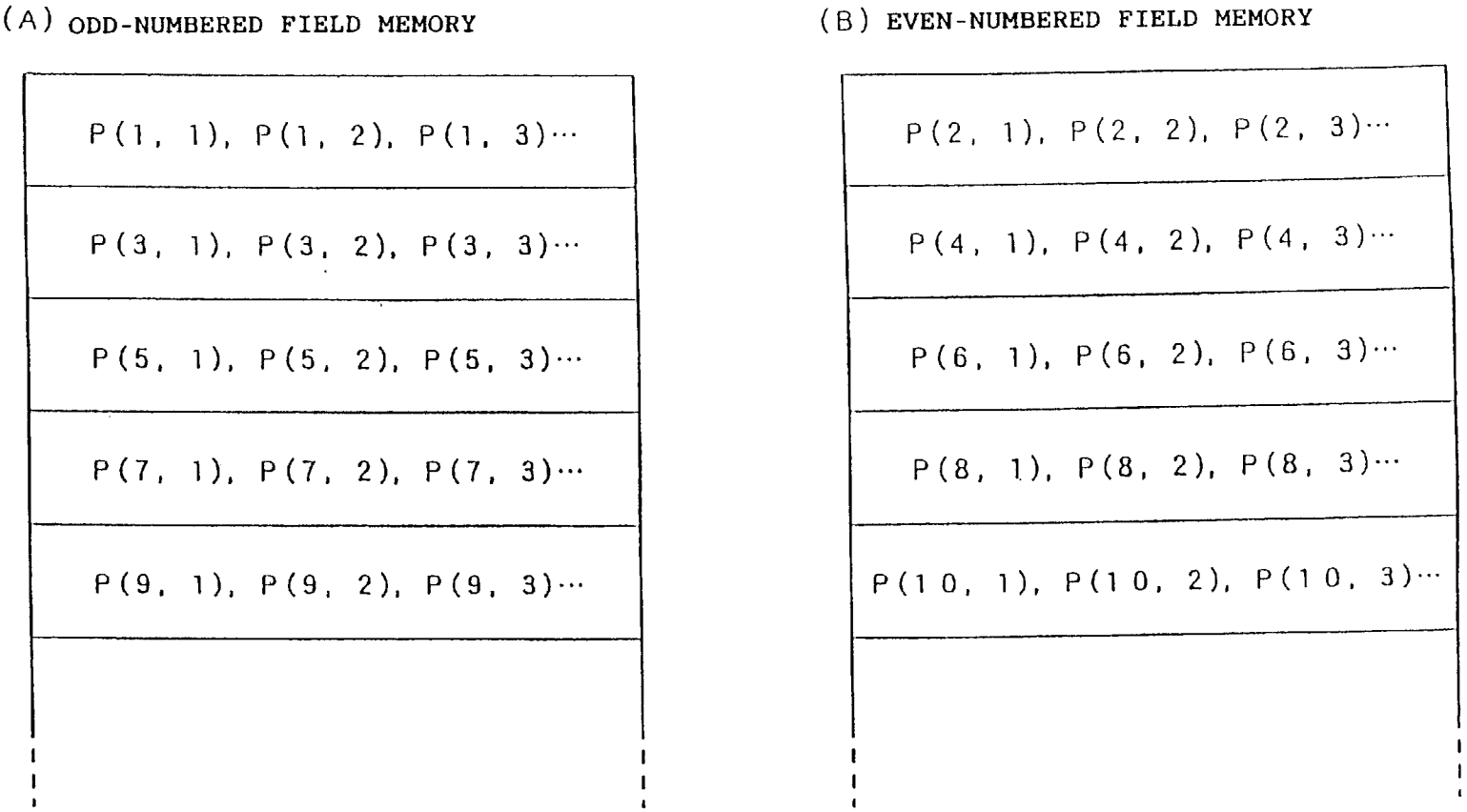

[Fig. 4]
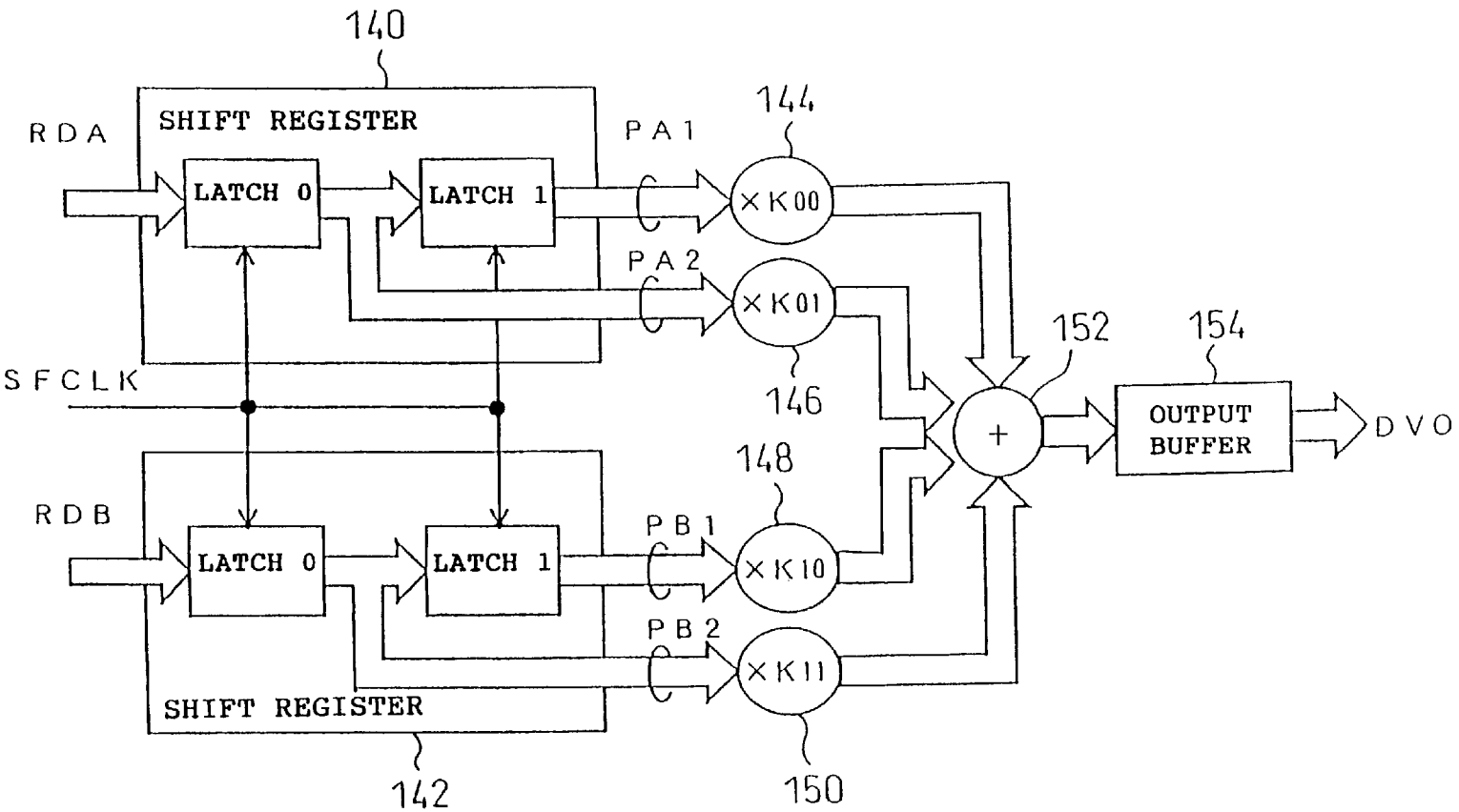

[Fig. 5]
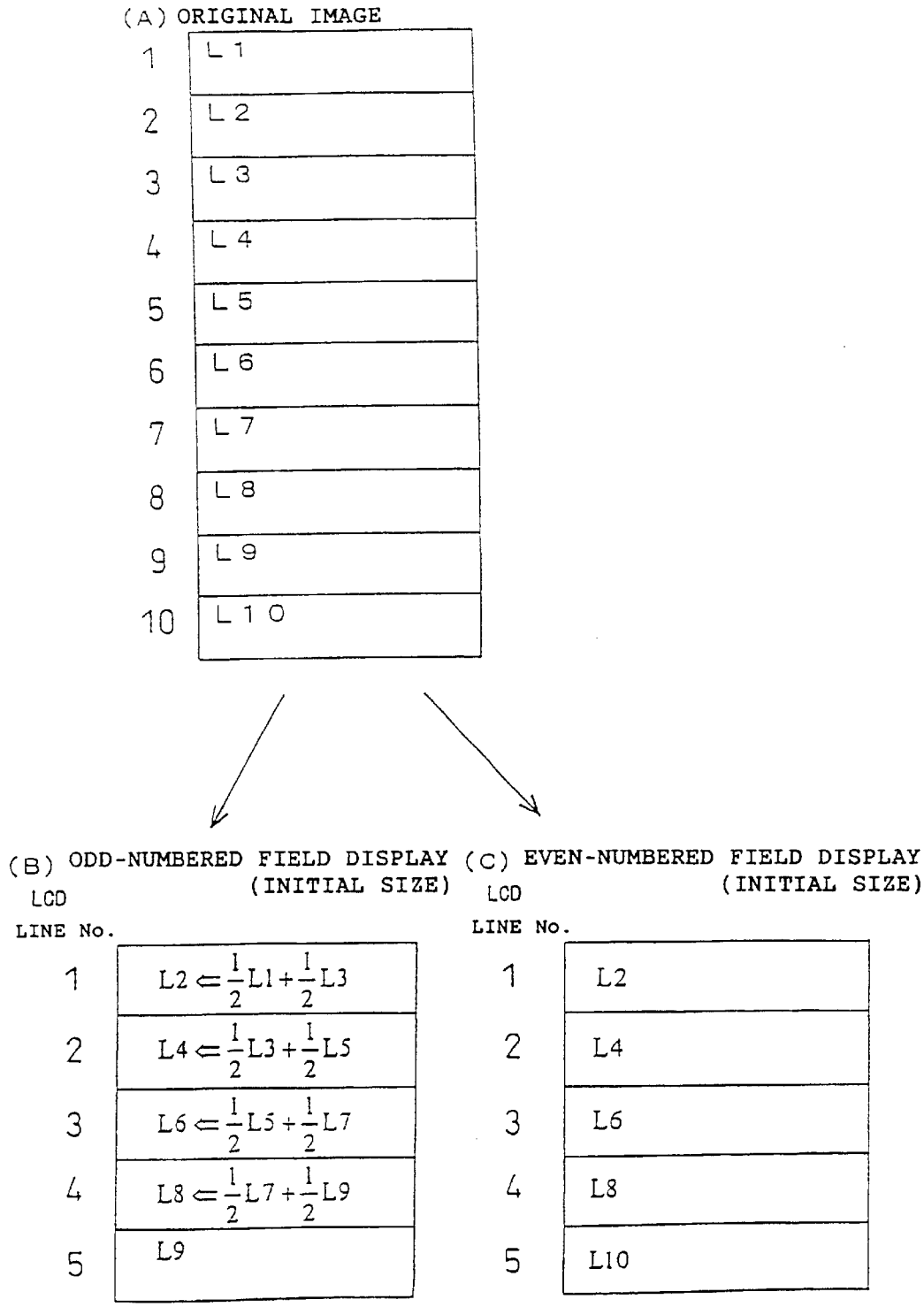

[Fig. 6]

| LCD LINE No. | |
|---|---|
| 1 | L2 |
| 2 | $L2\frac{2}{3}$ |
| 3 | $L3\frac{1}{3}$ |
| 4 | L4 |
| 5 | $L4\frac{2}{3}$ |
| 6 | $L5\frac{1}{3}$ |
| 7 | L6 |
| 8 | $L6\frac{2}{3}$ |
| 9 | $L7\frac{1}{3}$ |
| 10 | L8 |
| 11 | $L8\frac{2}{3}$ |
| 12 | $L9\left(L9\frac{1}{3}\right)$ |
| 13 | L9(L10) |
| 14 | $L9\left(L10\frac{2}{3}\right)$ |
| 15 | $L9\left(L11\frac{1}{3}\right)$ |

[Fig. 7]
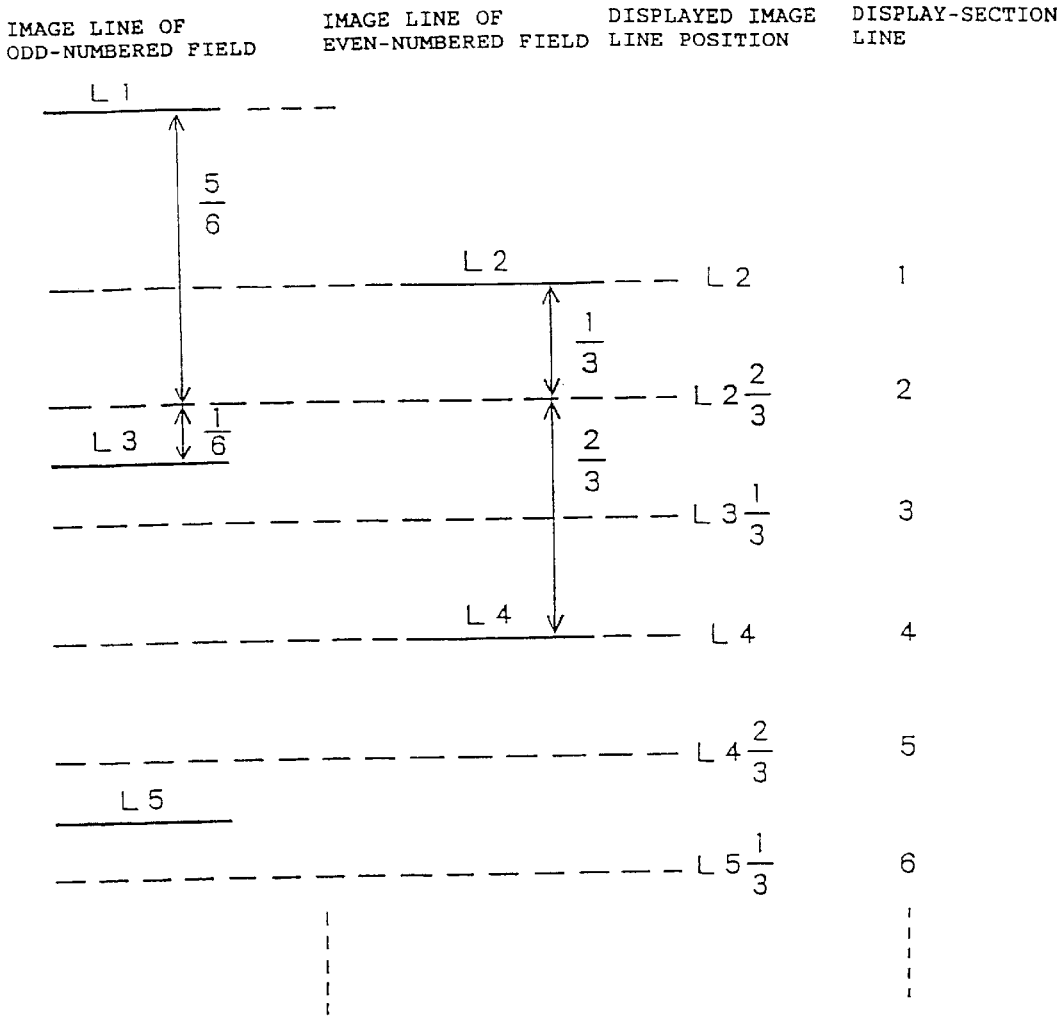
[Fig. 8]
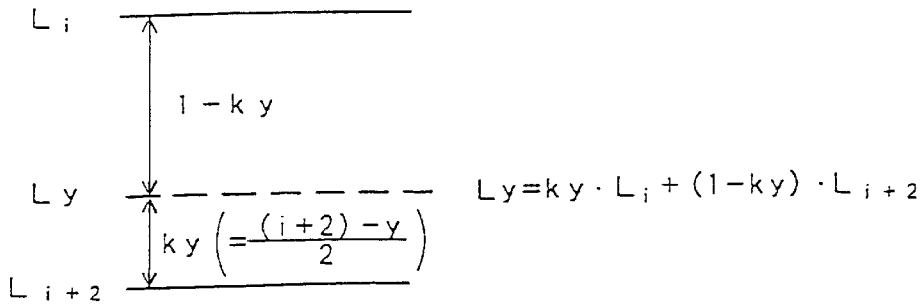

[Fig. 9]

IMAGE LINE INTERPOLATION EQUATIONS FOR THREE-TIMES ENLARGEMENT DISPLAY

| LCD LINE No. | ORIGINAL IMAGE LINE No. | ODD-NUMBERED FIELD LINE DATA | EVEN-NUMBERED FIELD LINE DATA |
|---|---|---|---|
| 1 | 2 | $\frac{1}{2}\cdot L1+\frac{1}{2}\cdot L3$ | $1\cdot L2$ |
| 2 | $2\frac{2}{3}$ | $\frac{1}{6}\cdot L1+\frac{5}{6}\cdot L3$ | $\frac{2}{3}\cdot L2+\frac{1}{3}\cdot L4$ |
| 3 | $3\frac{1}{3}$ | $\frac{5}{6}\cdot L3+\frac{1}{6}\cdot L5$ | $\frac{1}{3}\cdot L2+\frac{2}{3}\cdot L4$ |
| 4 | 4 | $\frac{1}{2}\cdot L3+\frac{1}{2}\cdot L5$ | $1\cdot L4$ |
| 5 | $4\frac{2}{3}$ | $\frac{1}{6}\cdot L3+\frac{5}{6}\cdot L5$ | $\frac{2}{3}\cdot L4+\frac{1}{3}\cdot L6$ |
| 6 | $5\frac{1}{3}$ | $\frac{5}{6}\cdot L5+\frac{1}{6}\cdot L7$ | $\frac{1}{3}\cdot L4+\frac{2}{3}\cdot L6$ |
| 7 | 6 | $\frac{1}{2}\cdot L5+\frac{1}{2}\cdot L7$ | $1\cdot L6$ |
| 8 | $6\frac{2}{3}$ | $\frac{1}{6}\cdot L5+\frac{5}{6}\cdot L7$ | $\frac{2}{3}\cdot L6+\frac{1}{3}\cdot L8$ |
| 9 | $7\frac{1}{3}$ | $\frac{5}{6}\cdot L7+\frac{1}{6}\cdot L9$ | $\frac{1}{3}\cdot L6+\frac{2}{3}\cdot L8$ |
| 10 | 8 | $\frac{1}{2}\cdot L7+\frac{1}{2}\cdot L9$ | $1\cdot L8$ |
| 11 | $8\frac{2}{3}$ | $\frac{1}{6}\cdot L7+\frac{5}{6}\cdot L9$ | $\frac{2}{3}\cdot L8+\frac{1}{3}\cdot L10$ |
| 12 | 9 | $1\cdot L9$ | $\frac{1}{2}\cdot L8+\frac{1}{2}\cdot L10$ |
| 13 | 9 | $1\cdot L9$ | $\frac{1}{2}\cdot L8+\frac{1}{2}\cdot L10$ |
| 14 | 9 | $1\cdot L9$ | $\frac{1}{2}\cdot L8+\frac{1}{2}\cdot L10$ |
| 15 | 9 | $1\cdot L9$ | $\frac{1}{2}\cdot L8+\frac{1}{2}\cdot L10$ |

[Fig. 10]

HORIZONTAL (PIXEL) →

| n \ m | 1 | 2 | 3 | 4 | | 12 | 13 | 14 | 15 |
|---|---|---|---|---|---|---|---|---|---|
| 1 | P(2, 1) | $P(2, 1\frac{1}{3})$ | $P(2, 1\frac{2}{3})$ | P(2, 2) | | $P(2, 4\frac{2}{3})$ | P(2, 5) | P(2, 5) | P(2, 5) |
| 2 | $P(2\frac{2}{3}, 1)$ | $P(2\frac{2}{3}, 1\frac{1}{3})$ | $P(2\frac{2}{3}, 1\frac{2}{3})$ | $P(2\frac{2}{3}, 2)$ | | $P(2\frac{2}{3}, 4\frac{2}{3})$ | $P(2\frac{2}{3}, 5)$ | $P(2\frac{2}{3}, 5)$ | $P(2\frac{2}{3}, 1)$ |
| 3 | $P(3\frac{1}{3}, 1)$ | $P(3\frac{1}{3}, 1\frac{1}{3})$ | $P(3\frac{1}{3}, 1\frac{2}{3})$ | $P(3\frac{1}{3}, 2)$ | | $P(3\frac{1}{3}, 4\frac{2}{3})$ | $P(3\frac{1}{3}, 5)$ | $P(3\frac{1}{3}, 5)$ | $P(3\frac{1}{3}, 5)$ |
| 4 | P(4, 1) | $P(4, 1\frac{1}{3})$ | $P(4, 1\frac{2}{3})$ | P(4, 2) | | $P(4, 4\frac{2}{3})$ | P(4, 5) | P(4, 5) | P(4, 5) |
| 12 | P(9, 1) | $P(9, 1\frac{1}{3})$ | $P(9, 1\frac{2}{3})$ | P(9, 2) | | $P(9, 4\frac{2}{3})$ | P(9, 5) | P(9, 5) | P(9, 5) |
| 13 | P(9, 1) | $P(9, 1\frac{1}{3})$ | $P(9, 1\frac{2}{3})$ | P(9, 2) | | $P(9, 4\frac{2}{3})$ | P(9, 5) | P(9, 5) | P(9, 5) |
| 14 | P(9, 1) | $P(9, 1\frac{1}{3})$ | $P(9, 1\frac{2}{3})$ | P(9, 2) | | $P(9, 4\frac{2}{3})$ | P(9, 5) | P(9, 5) | P(9, 5) |
| 15 | P(9, 1) | $P(9, 1\frac{1}{3})$ | $P(9, 1\frac{2}{3})$ | P(9, 2) | | $P(9, 4\frac{2}{3})$ | P(9, 5) | P(9, 5) | P(9, 5) |

VERTICAL (LINE) →

[Fig. 11]
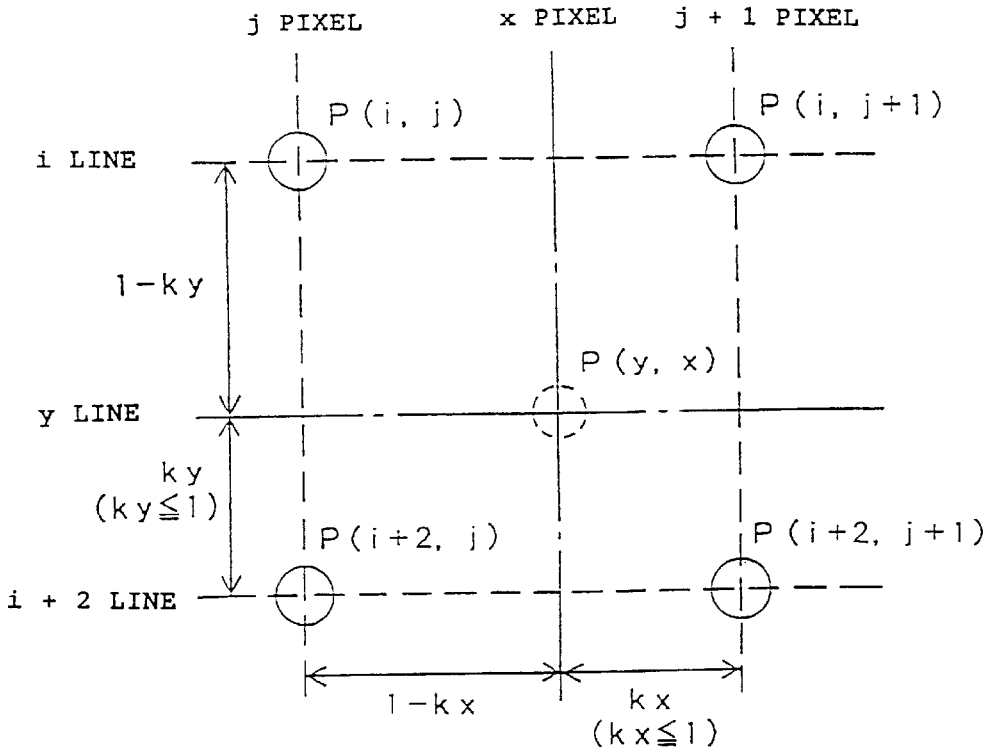
$$P(y,x)=[ky\ \ 1-ky]\begin{bmatrix} P(i,j) & P(i,j+1) \\ P(i+2,j) & P(i+2,j+1) \end{bmatrix}\begin{bmatrix} kx \\ 1-kx \end{bmatrix}$$
$$=\underbrace{ky\cdot kx}_{K_{00}}\cdot P(i,j)+\underbrace{ky\cdot(1-kx)}_{K_{01}}\cdot P(i,j+1)$$
$$+\underbrace{(1-ky)\cdot kx}_{K_{10}}\cdot P(i+2,j)+\underbrace{(1-ky)\cdot(1-kx)}_{K_{11}}\cdot P(i+2,j+1)$$

[Fig. 12]

(A) EVEN-NUMBERED FIELD CORRECTION COEFFICIENT DURING THREE-TIMES ENLARGEMENT

| LINE m | PIXEL n | K00 | K01 | K10 | K11 |
|---|---|---|---|---|---|
| 1 | 1 | 9/9 | 0/9 | 0/9 | 0/9 |
| 1 | 2 | 6/9 | 3/9 | 0/9 | 0/9 |
| 1 | 3 | 3/9 | 6/9 | 0/9 | 0/9 |
| 2 | 1 | 6/9 | 0/9 | 3/9 | 0/9 |
| 2 | 2 | 4/9 | 2/9 | 2/9 | 1/9 |
| 2 | 3 | 2/9 | 4/9 | 1/9 | 2/9 |
| 3 | 1 | 3/9 | 0/9 | 6/9 | 0/9 |
| 3 | 2 | 2/9 | 1/9 | 4/9 | 2/9 |
| 3 | 3 | 1/9 | 2/9 | 2/9 | 4/9 |

(B) ODD-NUMBERED FIELD CORRECTION COEFFICIENT DURING THREE-TIMES ENLARGEMENT

| LINE m | PIXEL n | K00 | K01 | K10 | K11 |
|---|---|---|---|---|---|
| 1 | 1 | 15/18 | 0/18 | 3/18 | 0/18 |
| 1 | 2 | 10/18 | 5/18 | 2/18 | 1/18 |
| 1 | 3 | 5/18 | 10/18 | 1/18 | 2/18 |
| 2 | 1 | 9/18 | 0/18 | 9/18 | 0/18 |
| 2 | 2 | 6/18 | 3/18 | 6/18 | 3/18 |
| 2 | 3 | 3/18 | 6/18 | 3/18 | 6/18 |
| 3 | 1 | 3/18 | 0/18 | 15/18 | 0/18 |
| 3 | 2 | 2/18 | 1/18 | 10/18 | 5/18 |
| 3 | 3 | 1/18 | 2/18 | 5/18 | 10/18 |

[Fig. 13]

(A) EVEN-NUMBERED FIELD CORRECTION COEFFICIENT DURING 5/4 TIMES ENLARGEMENT

| LINE m | PIXEL n | K00 | K01 | K10 | K11 |
|---|---|---|---|---|---|
| 1 | 1 | 25/25 | 0/25 | 0/25 | 0/25 |
| 1 | 2 | 5/25 | 20/25 | 0/25 | 0/25 |
| 1 | 3 | 10/25 | 15/25 | 0/25 | 0/25 |
| 1 | 4 | 15/25 | 10/25 | 0/25 | 0/25 |
| 1 | 5 | 20/25 | 5/25 | 0/25 | 0/25 |
| 2 | 1 | 5/25 | 0/25 | 20/25 | 0/25 |
| 2 | 2 | 1/25 | 4/25 | 4/25 | 16/25 |
| 2 | 3 | 2/25 | 3/25 | 8/25 | 12/25 |
| 2 | 4 | 3/25 | 2/25 | 12/25 | 8/25 |
| 2 | 5 | 4/25 | 1/25 | 16/25 | 4/25 |
| 3 | 1 | 10/25 | 0/25 | 15/25 | 0/25 |
| 3 | 2 | 2/25 | 8/25 | 3/25 | 12/25 |
| 3 | 3 | 4/25 | 6/25 | 6/25 | 9/25 |
| 3 | 4 | 6/25 | 4/25 | 9/25 | 6/25 |
| 3 | 5 | 8/25 | 2/25 | 12/25 | 3/25 |
| 4 | 1 | 15/25 | 0/25 | 10/25 | 0/25 |
| 4 | 2 | 3/25 | 12/25 | 2/25 | 8/25 |
| 4 | 3 | 6/25 | 9/25 | 4/25 | 6/25 |
| 4 | 4 | 9/25 | 6/25 | 6/25 | 4/25 |
| 4 | 5 | 12/25 | 3/25 | 8/25 | 2/25 |
| 5 | 1 | 20/25 | 0/25 | 5/25 | 0/25 |
| 5 | 2 | 4/25 | 16/25 | 1/25 | 4/25 |
| 5 | 3 | 8/25 | 12/25 | 2/25 | 3/25 |
| 5 | 4 | 12/25 | 8/25 | 3/25 | 2/25 |
| 5 | 5 | 16/25 | 4/25 | 4/25 | 1/25 |

(B) ODD-NUMBERED FIELD CORRECTION COEFFICIENT DURING 5/4 TIMES ENLARGEMENT

| LINE m | PIXEL n | K00 | K01 | K10 | K11 |
|---|---|---|---|---|---|
| 1 | 1 | 25/50 | 0/50 | 25/50 | 0/50 |
| 1 | 2 | 5/50 | 20/50 | 5/50 | 20/50 |
| 1 | 3 | 10/50 | 15/50 | 10/50 | 15/50 |
| 1 | 4 | 15/50 | 10/50 | 15/50 | 10/50 |
| 1 | 5 | 20/50 | 5/50 | 20/50 | 5/50 |
| 2 | 1 | 35/50 | 0/50 | 15/50 | 0/50 |
| 2 | 2 | 7/50 | 28/50 | 3/50 | 12/50 |
| 2 | 3 | 14/50 | 21/50 | 6/50 | 9/50 |
| 2 | 4 | 21/50 | 14/50 | 9/50 | 6/50 |
| 2 | 5 | 28/50 | 7/50 | 12/50 | 3/50 |
| 3 | 1 | 45/50 | 0/50 | 5/50 | 0/50 |
| 3 | 2 | 9/50 | 36/50 | 1/50 | 4/50 |
| 3 | 3 | 18/50 | 27/50 | 2/50 | 3/50 |
| 3 | 4 | 27/50 | 18/50 | 3/50 | 2/50 |
| 3 | 5 | 36/50 | 9/50 | 4/50 | 1/50 |
| 4 | 1 | 5/50 | 0/50 | 45/50 | 0/50 |
| 4 | 2 | 1/50 | 4/50 | 9/50 | 36/50 |
| 4 | 3 | 2/50 | 3/50 | 18/50 | 27/50 |
| 4 | 4 | 3/50 | 2/50 | 27/50 | 18/50 |
| 4 | 5 | 4/50 | 1/50 | 36/50 | 9/50 |
| 5 | 1 | 15/50 | 0/50 | 35/50 | 0/50 |
| 5 | 2 | 3/50 | 12/50 | 7/50 | 28/50 |
| 5 | 3 | 6/50 | 9/50 | 14/50 | 21/50 |
| 5 | 4 | 9/50 | 6/50 | 21/50 | 14/50 |
| 5 | 5 | 12/50 | 3/50 | 27/50 | 7/50 |

[Fig. 14]
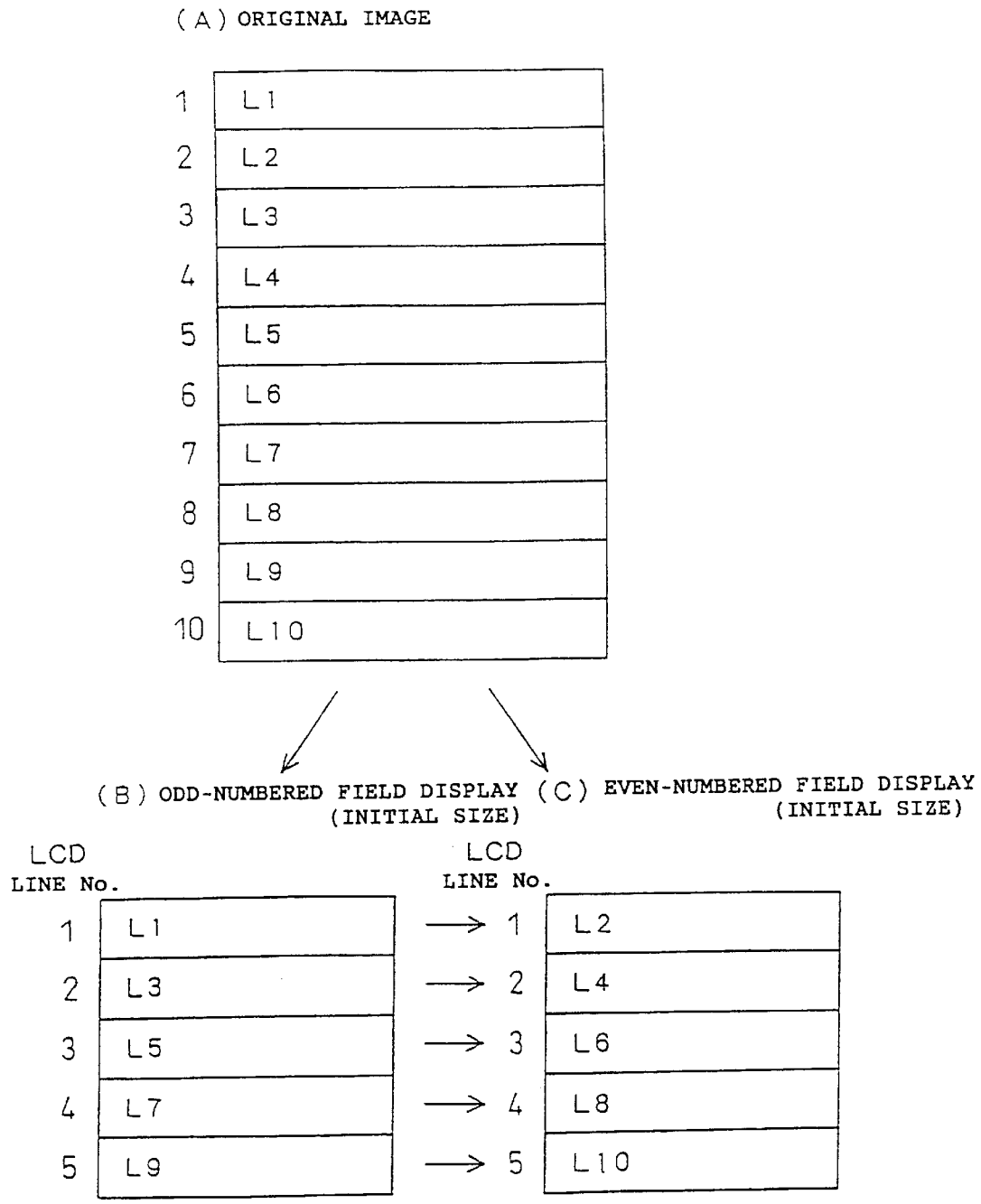

[Fig. 15]

(A) ODD-NUMBERED FIELD DISPLAY (THREE TIMES)

| LCD LINE No. | |
|---|---|
| 1 | L1 |
| 2 | $L1\frac{2}{3}$ |
| 3 | $L2\frac{1}{3}$ |
| 4 | L3 |
| 5 | $L3\frac{2}{3}$ |
| 6 | $L4\frac{1}{3}$ |
| 7 | L5 |
| 8 | $L5\frac{2}{3}$ |
| 9 | $L6\frac{1}{3}$ |
| 10 | L7 |
| 11 | $L7\frac{2}{3}$ |
| 12 | $L8\frac{1}{3}$ |
| 13 | L9 |
| 14 | L9 |
| 15 | L9 |

(B) EVEN-NUMBERED FIELD DISPLAY (THREE TIMES)

| LCD LINE No. | |
|---|---|
| → 1 | L2 |
| → 2 | L2 |
| → 3 | $L2\frac{2}{3}$ |
| → 4 | $L3\frac{1}{3}$ |
| → 5 | L4 |
| → 6 | $L4\frac{2}{3}$ |
| → 7 | $L5\frac{1}{3}$ |
| → 8 | L6 |
| → 9 | $L6\frac{2}{3}$ |
| → 10 | $L7\frac{1}{3}$ |
| → 11 | L8 |
| → 12 | $L8\frac{2}{3}$ |
| → 13 | $L9\frac{1}{3}$ |
| → 14 | L10 |
| → 15 | L10 |

IMAGE PROCESSING METHOD AND IMAGE DISPLAY

BACKGROUND OF THE INVENTION

1. Field of the Invention

The present invention relates to image processing technology for displaying images, in accordance with image signals of an interlace method, by a non-interlace method.

2. Description of Related Art

For video signals used for displaying an image in television and video, a commonly called interlace method is employed. In the interlace method, an image for one screen, including a plurality of horizontal lines, is divided into odd-numbered lines and even-numbered lines which are displayed alternately on the screen. An image including all the odd-numbered. lines and the even-numbered lines is called a "frame", while an image represented by the odd-numbered lines and an image represented by the even-numbered lines are called an "odd-numbered field" and an "even-numbered field", respectively.

Since cathode-ray tubes chiefly used in television and video have a relatively long after-image time, even if the odd-numbered lines and the even-numbered lines are alternately displayed by the interlace method, flickering of images is not noticed much. In contrast, since a liquid-crystal panel has a relatively short after-image time, if an image is displayed by the interlace method, the image appears to flicker. Consequently, in the liquid-crystal panel, a non-interlace method is employed for supplying an image signal to all the lines of the liquid-crystal panel each time. When an image is to be displayed in the liquid-crystal panel in accordance with an interlaced video signal, the interlaced video signal is converted into a non-interlaced display image signal and supplied to the liquid-crystal panel.

FIGS. 14(A), 14(B), and 14(C) are illustrations showing an example in which an interlaced video signal is displayed in a liquid-crystal panel (LCD panel) by a non-interlace method. An original image shown in FIG. 14(A) has 100 horizontal lines. At this time, when an odd-numbered field image is displayed in the liquid-crystal panel by the non-interlace method, as shown in FIG. 14(B), line data L1, L3, L5, L7, and L9 of the odd-numbered lines of the original image are provided to each of the five lines of the liquid-crystal panel. The letter and numeral "L1" indicates the image data of the first line of the original image. On the other hand, when an even-numbered field image is displayed in the liquid-crystal panel, as shown in FIG. 14(C), line data L2, L4, L6, L8, and L10 of the even-numbered lines of the original image are provided to each of the five lines of the liquid-crystal panel. As a comparison between FIG. 14(B) and FIG. 14(C) shows, the line positions in the original image of the line data of the odd-numbered fields and the even-numbered fields provided to the same lines of the liquid-crystal panel differ. For this reason, flicker occurs in the displayed image.

In this specification, the size of the image displayed, with the lines of each field being arranged without a clearance, as in FIGS. 14(B) and 14(C), is called an "initial size". Therefore, the width in the vertical direction at the initial size of the displayed image is one half that of the original image, and the width in the horizontal direction is equal to that of the original image. The magnification of the display image is assumed to be calculated by using this initial size as a reference.

FIGS. 15(A) and 15(B) are illustrations showing an example in which the image is enlarged three times in the vertical direction when the interlaced video signal shown in FIG. 14(A) is displayed in the liquid-crystal panel by the non-interlace method. The image data representing the lines added by enlargement is created by straight-line interpolation of the image data of the original lines of each field. As can be seen from a comparison between FIGS. 15(A) and 15(B), the line positions in the original image of the line data of the odd-numbered fields and the even-numbered fields provided to the same lines of the liquid-crystal panel differ. Therefore, also in this case, flicker occurs in the displayed image.

As described above, conventionally, since the line positions in the original image of the image signal provided to the same line of the liquid-crystal panel deviate between the odd-numbered fields and the even-numbered fields, a problem arises in that flicker occurs in the displayed image. Such a problem is not limited to a case in which a liquid-crystal panel is used, but broadly, is a problem common to a case in which an interlaced image signal is converted into a non-interlaced one and displayed at a desired magnification.

SUMMARY OF THE INVENTION

This invention has been achieved to solve the above-described problems of the conventional technology. An object of the present invention is to provide technology which is capable of reducing flicker when an interlaced image signal is converted into a non-interlaced one and displayed at a desired magnification.

The above-described problems are solved by the image processing method, the image processing apparatus, and the image display apparatus described below.

The image processing method of the present invention is an image processing method for supplying, by a non-interlace method, image signals to a light modulation section in accordance with two field image signals for displaying the odd-numbered line fields and the even-numbered line fields of an original image by an interlace method, the image processing method comprising the steps of:

generating two image signals for display to be alternately provided to the light modulation section from the two field image signals, respectively, in order to alternately supply, by a non-interlace method, the image signals representing the two images, in which two field images represented by the two field image signals are each enlarged a times in the vertical direction, to the light modulation section; and generating the two image signals for display by performing interpolation of at least one of the two field image signals so that each pair of signals among the signals of each line of the two image signals for display, which are alternately provided to the same line of the light modulation section, indicate the image at mutually equal line positions defined within said original image.

Here, the "light modulation section" refers to an apparatus for generating light from which an image in accordance with an image signal can be visually recognized. As the light modulation section, for example, various apparatuses, such as a liquid-crystal panel, a plasma display panel, and a CRT, may be used.

According to the image processing method of the present invention, two image signals for display which are alternately provided to the same line of the light modulation section represent an image at mutually equal line positions defined within the original image. Therefore, there is no occurrence of the two field images supplied to the light modulation section being deviated from each other in the vertical direction. This makes it possible to prevent an occurrence of flicker when an image signal representing an enlarged/reduced image in the vertical direction in accordance with an interlaced image signal is supplied to the light modulation section by a non-interlace method.

In the above-described image processing method, when the two field images are further enlarged b times in the horizontal direction, an image signal representing a target pixel, which is a pixel on each line of the light modulation section, is generated by performing interpolation of image signals of four pixels contained in the odd-numbered line fields and in the even-numbered line fields in the original image, respectively, in the odd-numbered line fields and the even-numbered line fields, and as the four pixels, the closest four pixels which surround the target pixel in a lattice form may be selected.

According to the above-described method, it is possible to provide image data at the same pixel position within the original image to the same pixels of the light modulation section in either the odd-numbered line fields or the even-numbered line fields. As a result, when image signals representing an image which is enlarged/reduced at a desired magnification in the vertical direction and in the horizontal direction in accordance with an interlaced image signal are supplied to the light modulation section by a non-interlace method, occurrence of flicker can be prevented.

The image display apparatus of the present invention is an image display apparatus for supplying, by a non-interlace method, image signals to a light modulation section in accordance with two field image signals for displaying the odd-numbered line fields and the even-numbered line fields of an original image by an interlace method, the image display apparatus comprising:

an image processing section, in order to alternately supply, by a non-interlace method, image signals representing two images, in which two field images represented by the two field image signals are each enlarged a times in the vertical direction to the light modulation section, for generating two image signals for display to be alternately provided to the light modulation section from the two field image signals, respectively, and for generating the two image signals for display by performing interpolation of at least one of the two field image signals so that the two image signals for display generated based on the respective two field image signals, which are alternately provided to the same line of said light modulation section, indicate the image at mutually equal line positions defined within said original image.

When the two field images are each enlarged b times in the horizontal direction, the image processing section may generate an image signal representing a target pixel, which is a pixel on each line of the light modulation section by interpolating the respective four pixels contained in the odd-numbered line fields and the even-numbered line fields in the original image, respectively, in the odd-numbered line fields and in the even-numbered line fields, and as the four pixels, the four closest pixels which surround the target pixel in a lattice form may be selected.

According to the above-described image display apparatus, similarly to the above-described image processing method, when image signals representing an image which is enlarged/reduced in accordance with interlaced image signals are supplied to the light modulation section by a non-interlace method, occurrence of flicker can be prevented.

BRIEF DESCRIPTION OF THE DRAWINGS

FIG. 1 is a block diagram showing the construction of an image processing method and an image display apparatus according to an embodiment of the present invention.

FIG. 2 is a schematic block diagram showing an example of the construction of an image enlargement/reduction processing section 50.

FIGS. 3(A) and 3(B) are illustrations showing the stored contents of an ODD memory 110*a* and an EVEN memory 110*b*.

FIG. 4 is a block diagram showing the internal construction of an interpolation processing circuit 126.

FIGS. 5(A), 5(B), and 5(C) are illustrations showing the odd-numbered fields and the even-numbered fields when an image is displayed at an initial size.

FIG. 6 is an illustration showing the line position of the original image of the even-numbered fields to be displayed in each line of a liquid-crystal display panel when the image of the initial size shown in FIGS. 5(B) and 5(C) is enlarged three times and displayed.

FIG. 7 is an illustration showing the relationship between the image line position in each display line of the liquid-crystal display panel and the image line which is primarily contained in the odd-numbered fields and the even-numbered fields.

FIG. 8 is an illustration showing a method for interpolating an image line position Ly.

FIG. 9 is an illustration showing image. line interpolation equations in the odd-numbered fields and the even-numbered fields which are provided to each display-section line when the image is enlarged three times and displayed.

FIG. 10 is an illustration showing image data of the original image provided to each pixel on each line of a liquid-crystal display panel 80 when the image is enlarged three times in the vertical direction and in the horizontal direction.

FIG. 11 is an illustration showing a method for interpolating a pixel P(y, x).

FIGS. 12(A) and 12(B) are illustrations showing coefficients K00, K01, K10, and K11 used when the image is enlarged three times in the vertical direction and in the horizontal direction.

FIGS. 13(A) and 13(B) are illustrations showing coefficients K00, K01, K10, and K11 used when the image is enlarged 5/4 times in the vertical direction and in the horizontal direction.

FIGS. 14(A), 14(B), and 14(C) are illustrations showing an example in which an interlaced video signal is displayed in the liquid-crystal panel by a non-interlace method.

FIGS. 15(A) and 15(B) are illustrations showing an example in which the image is enlarged three times in the vertical direction when the interlaced video signal shown in FIG. 14(A) is displayed in the liquid-crystal panel by a non-interlace method.

DESCRIPTION OF THE PREFERRED EMBODIMENTS

A description is given in more detail below with reference to the embodiment of the present invention shown in the figures.

A. Overall construction of the image processing apparatus and the image display apparatus:

Next, the mode of working of the present invention is described with reference to the embodiment. FIG. 1 is a block diagram showing the construction of an image display apparatus according to an embodiment of the present invention. This image display apparatus is a computer system comprising an image processing section 100, a liquid-crystal display driving section 70, and a liquid-crystal display panel 80 as a light modulation section. The image processing section 100 comprises a synchronization separation section 20, a signal specification conversion section 30, an AD conversion section 40, an image enlargement/reduction processing section 50, and a CPU 60. This image display apparatus is a projection-type display apparatus (so-called projector) which projects an image displayed on the liquid-crystal display panel 80 onto a projection screen by using an optical system (not shown) and displays the image.

The image processing section 100 may be formed separately from the liquid-crystal display driving section 70 and the liquid-crystal display panel 80. Also, a display apparatus (for example, a plasma display panel or a CRT) of a type different from the liquid-crystal display panel 80 may be used.

The synchronization separation section 20 separates a composite image signal VS (image signal in which a luminance signal and a synchronization signal are superimposed on each other) of an interlace method into a vertical synchronization signal VD1 and a horizontal synchronization signal HD1, and determines whether the input image signal is an image signal of the odd-numbered field or an image signal of the even-numbered field and outputs a field signal FD.

The signal specification conversion section 30 converts the composite image signal VS to a component image signal RGBS (image signal which does not contain a synchronization signal) of three colors, R (red), G (green), and B (blue). The component image signal RGBS is converted into a digital image signal DVI in the AD conversion section 40 and is input to the image enlargement/reduction processing section 50.

A sampling clock signal DCLK1 used for AD conversion is supplied from the image enlargement/reduction processing section 50.

The image enlargement/reduction processing section 50 outputs the digital image signal DVI of each field output from the AD conversion section 40 as an output image signal DV0 according to the processing conditions supplied from the CPU 60. At this time, it is also possible to perform enlargement or reduction processing of an image. Furthermore, the image enlargement/reduction processing section 50 outputs a horizontal synchronization signal HD2, a vertical synchronization signal VD2, and a dot clock signal DCLK2 for displaying an image on the liquid-crystal display panel 80. The details of the image enlargement/reduction processing section 50 will be described later.

The liquid-crystal display driving section 70 displays an image on the liquid-crystal display panel 80 according to the output image signal DVO, the vertical synchronization signal VD2, the horizontal synchronization signal HD2, and the dot clock signal DCLK2.

B. Construction of the image enlargement/reduction processing section 50:

FIG. 2 is a schematic block diagram showing an example of the construction of the image enlargement/reduction processing section 50. The image enlargement/reduction processing section 50 comprises a field memory 110, a write clock generation circuit 112, a write control circuit 114, a read control circuit 116, a synchronization signal generation circuit 118, an enlargement/reduction processing control circuit 120, a line memory 122, a line memory control circuit 124, an interpolation processing circuit 126, a coefficient selection control circuit 128, an ODD coefficient memory 130, an EVEN coefficient memory 132, and a control condition register 134.

The control condition register 134 is a register for storing various control conditions in the image processing apparatus. These conditions are set by the CPU 60 via a bus. In FIG. 2, blocks marked with "*" are respectively connected to the control condition register 134, and the respective processes are performed in accordance with the conditions stored in the control condition register 134.

The field memory 110 comprises two memories of an ODD memory 110*a* and an EVEN memory 110*b*. FIGS. 3(A) and 3(B) are illustrations showing the stored contents of the ODD memory 110*a* and the EVEN memory 110*b*. P(y, x) in the figure indicates an image signal of the x-th pixel on the y-th line. The ODD memory 110*a* stores the image signals of the odd-numbered fields among the digital image signals DVI output from the AD conversion section 40. In contrast, the EVEN memory 110*b* stores the image signals of the even-numbered fields. That is, the ODD memory 110*a* stores the image signals of the lines L1, L3, L5, . . . , as shown in FIG. 3(A), and the EVEN memory 110*b* stores the image signals of the lines L2, L4, L6, . . . , as shown in FIG. 3(B). In this embodiment, two memories are used. In addition, one memory capable of storing image signals for two fields may be used. As a field memory, various memories, such as DRAM, SRAM, or VRAM, may be used.

The write clock generation circuit 112 of FIG. 2 generates a dot clock signal DCLK1 which is synchronized with the horizontal synchronization signal HD1. This dot clock signal DCLK1 is used as a sampling clock for the AD conversion section 40. A PLL circuit (not shown) is provided within the write clock generation circuit 112, and this PLL circuit generates a dot clock signal DCLK1 according to the frequency-division ratio which is set in the control condition register 134. This frequency-division ratio corresponds to the ratio of the frequency of the horizontal synchronization signal HD1 to that of the dot clock signal DCLK1.

The write control circuit 114 performs control so that the image signal DVI output from the AD conversion section 40 is written into the field memory 110. This write control is performed in accordance with the synchronization signals HD1/VD1 and the dot clock signal DCLK1 on the basis of the image capturing conditions (for example, condition indicating which range of the image should be captured by using the synchronization signals HD1/VD1 as a reference) stored in the control condition register 134.

The synchronization signal generation circuit 118 generates a horizontal synchronization signal HD2, a vertical synchronization signal VD2, and a dot clock signal DCLK2. These signals are used in various processing for reading image data stored in the field memory 110 and displaying it on the liquid-crystal display panel 80.

The frequency of the synchronization signals HD2 and VD2 is determined to be the value of a frequency at which a processing time required to perform an enlargement/reduction process on an image read from the field memory 110 can be sufficiently taken from the range of frequencies preferable for displaying the image on the liquid-crystal display panel 80. The dot clock signal DCLK2 is generated in accordance with the horizontal synchronization signal HD2 by a PLL circuit (not shown) in a manner similar to the dot clock signal DCLK1. The control conditions for generating these signals HD2, VD2, and DCLK2 are supplied from the control condition register 134.

The enlargement/reduction processing control circuit 120 controls the read control circuit 116, the line memory control circuit 124, and the coefficient selection control circuit 128 on the basis of the enlargement/reduction control conditions stored in the control condition register 134. This causes the image data read from the field memory 110 to be enlarged/reduced and interpolated, and the data is supplied to the liquid-crystal display panel 80. As a result, an image of a desired magnification is displayed.

This image display process is performed in accordance with the dot clock signal DCLK2 and the synchronization signals HD2/VD2 supplied from the synchronization signal generation circuit 118.

When an image is to be displayed, first, the read control circuit 116 reads image data RD from the field memory 110 in accordance with a read control signal FREQ supplied from the enlargement/reduction processing control circuit 120. The image data RD read from the field memory 110 is stored in the line memory 122 via the line memory control circuit 124. That is, the line memory control circuit 124 stores the image data RD read from the field memory 110 in three line memories 122*a,* 122*b,* and 122*c* in sequence for each line in accordance with a write control signal LMW supplied from the enlargement/reduction processing control circuit 120. Furthermore, while the image data RD is being written into one of the line memories, a process for reading image data RDA and RDB for two lines from the other two line memories in sequence for each pixel is also performed at the same time. The image data RDA is image data which is written in the line memory 122 one line earlier than the image data RDB. The write control signal LMW and the read control signal LMR are output in accordance with the read control signal FREQ.

The interpolation processing circuit 126 creates image data DVO to be provided to each line of the liquid-crystal display panel 80 by using the image data RDA and RDB read from the line memory 122. FIG. 4 is a block diagram showing the internal construction of the interpolation processing circuit 126. The interpolation processing circuit 126 comprises two shift registers 140 and 142, four multiplication circuits 144, 146, 148, and 150, an addition circuit 152, and an output buffer 154. The image data RDA and RDB for two lines supplied from the line memory control circuit 124 are input in sequence for each pixel to the first and second shift registers 140 and 142, respectively. The first and second shift registers 140 and 142 are two-stage latch circuits. Each time image data of one pixel is read from the line memory 122 and input, the image data shifts by one stage in accordance with a shift clock SFCLK. This shift clock SFCLK is output from the line memory control circuit 124 or the enlargement/reduction processing control circuit 120 in accordance with the read control signal LMR.

For example, when the image data of the first pixels on two lines is input to the shift registers 140 and 142, respectively, the image data of the first pixels is latched by a latch 0 of the first stage when the shift clock SFCLK changes. Next, when the image data of the second pixels is input to the shift registers 140 and 142, the latch 0 of the first stage latches the image data of the second pixels when the shift clock SFCLK changes. Also, the image data of the first pixels latched by the latch 0 of the first stage is latched by the latch 1 of the second stage when the shift clock SFCLK changes. As a result, the image data of the first pixel of the first line input to the first shift register 140 is output as image data PA1, and the image data of the second pixel is output as image data PA2. Also, the image data of the first pixel of the second line input to the second shift register 142 is output as image data PB1, and the image data of the second pixel is output as image data PB2.

The image data PA1, PA2, PB1, and PB2 output from the shift registers 140 and 142 are multiplied by the respective coefficients K00, K01, K10, and K11 in the multiplication circuits 144, 146, 148, and 150, respectively, and are input to the addition circuit 152. The coefficients K00, K01, K10, and K11 of the multiplication circuits 144, 146, 148, and 150 are stored in the ODD coefficient memory 130 or in the EVEN coefficient memory 132, and these are supplied via the coefficient selection control circuit 128 according to whether the image data input to the interpolation processing circuit 126 is image data of an odd-numbered field or an even-numbered field. That is, if the input image data is image data of an odd-numbered field, the coefficient stored in the ODD coefficient memory 130 is selected, and if the input image data is image data of an even-numbered field, the coefficient stored in the EVEN coefficient memory 132 is selected. The addition circuit 152 outputs a summation value (K00·PA1+K01·PA2+K10·PB1+K11·PB2) of the image data which are input from the four multiplication circuits 144, 146, 148, and 150. This summation value is used as image data after interpolation. That is, this interpolation processing circuit 126 is a matrix computation circuit of two rows and two columns, which interpolates image data of a particular pixel from the image data of four pixels. This interpolation process will be described later.

The output buffer 152 outputs the image data output from the addition circuit 152 as an image signal DVO in synchronization with the synchronization signals HD2/VD2 and the dot clock signal DCLK2.

The coefficient selection control circuit 128 shown in FIG. 2 supplies the coefficients K00, K01, K10, and K11 to the interpolation processing circuit 126 in accordance with a selection control signal FSEL supplied from the enlargement/reduction processing control circuit 120 for each pixel of each line. This selection control signal FSEL is supplied to the coefficient selection control circuit 128 in accordance with an image output cycle for the liquid-crystal display panel 80.

The coefficients stored in the ODD coefficient memory 130 and in the EVEN coefficient memory 132 are calculated by the CPU 60 according to the size, that is, the enlargement/reduction ratio, of the image displayed on the liquid-crystal display panel 80 with respect to the image of each field written into the field memory 110. Alternatively, it is possible that a plurality of sets of coefficients corresponding to a plurality of amounts of enlargement/reduction of the image are prestored in the ODD coefficient memory 130 or in the EVEN coefficient memory 132 and that one set is selected by the coefficient selection control circuit 128 according to the set enlargement/reduction ratio of the image.

In a manner as described above, the image enlargement/reduction processing section 50 converts an interlaced image input from the AD conversion section 40 into an non-interlaced image and displays the image at a desired magnification on the liquid-crystal display panel 80.

C. Interpolation process in the vertical direction:

As described below, the interpolation processing circuit 126 performs interpolation processing on at least one of the odd-numbered fields and the even-numbered fields so that the image data at the same line position within the original image is always supplied to the same line of the liquid-crystal display panel 80. FIGS. 5(B) and 5(C) are illustrations showing the odd-numbered fields and the even-numbered fields when the image is displayed at the initial size in this embodiment. The original image shown in FIG. 5(A) and the even-numbered fields shown in FIG. 5(C) are the same as those of FIGS. 14(A) and 14(C) described in the conventional technology.

In the odd-numbered fields shown in FIG. 5(B), the image is interpolated in the vertical direction in such a manner as to display the image at an image line position which is the same as that of the even-numbered fields. Here, the "image line" means a line within the original image, and the "image line position" means a line position defined within the original image. The value of the image line position may be, in addition to an integer, a value including a decimal as will be described later. The line of the liquid-crystal display panel 80 is called a "display-section line" so as to distinguish it from the image line.

As shown in FIGS. 5(B) and 5(C), an image line L2 is displayed in either the odd-numbered fields or the even-numbered fields in the first display-section line of the liquid-crystal display panel 80. In the odd-numbered fields, the interpolation processing circuit 126 determines the image of the image line L2 by interpolating (simply averaging) the images of the two image lines L1 and L3 contained in the odd-numbered fields in order to display the image line L2 in the first display-section line of the liquid-crystal display panel 80. Although the image of the image line L2 of the odd-numbered fields obtained in this manner is not completely the same as the image of the image line L2 of the even-numbered fields, both considerably resemble each other, making it possible to prevent flicker. Also for the other display-section lines of the liquid-crystal display panel 80, in a similar manner, the image of the odd-numbered fields is interpolated so that the image at the same image line position can be displayed in the odd-numbered fields and in the even-numbered fields. However, at the lowest end of the odd-numbered fields, the image of the image line L10 which is the same as the lowest end of the even-numbered fields cannot be determined by interpolation. Therefore, since at only the lowest display-section line, the image is displayed at the image line position at which the odd-numbered fields and the even-numbered fields are different, some flicker may occur here. However, in an actual image display apparatus, since the number of display-section lines often becomes 200 to 300 or more, even if some flicker occurs at only the lowest display-section line, no problem is posed for practical use.

In the example of FIGS. 5(A), 5(B), and 5(C), the image of the odd-numbered fields is interpolated in such a manner as to be aligned with the image line position of the even-numbered fields. In contrast, the image of the even-numbered fields may be interpolated in such a manner as to be aligned with the image line position of the odd-numbered fields. In this case, since, in the line of the uppermost end of the even-numbered fields, the image at the image line position which is the same as the line of the uppermost end (the image line L1) of the odd-numbered fields cannot be determined by interpolation, the odd-numbered fields and the even-numbered fields display the images at the different image line positions at only the line of the uppermost end. In this manner, the image line position of the image supplied to the same display-section line is adjusted so as to be as much as possible the same at the odd-numbered fields and the even-numbered fields, but in the display-section line of the uppermost end or the lowest end, the image line positions of the odd-numbered fields and the even-numbered fields may be different.

In this specification, the phrase that "the image at the same image line position is displayed at the same display-section line in either the odd-numbered fields or the even-numbered fields" allows that the image at different image line positions be displayed at a small number of display-section lines near the uppermost end or the lowest end in this manner, and the image at the same image line position needs only be displayed at the other display-section lines excluding a small number of lines near the uppermost end or the lowest end.

FIG. 6 is an illustration showing the line position of the original image of the even-numbered fields to be displayed in each line of a liquid-crystal display panel when the image of the initial size shown in FIGS. 5(B) and 5(C) is enlarged three times and displayed.

When the image is to be enlarged three times, the image lines in the even-numbered fields, supplied to each of the display-section lines 1, 2, 3, 4, . . . of the liquid-crystal display panel 80 become L2, L(2+2/3), L(3+1/3), L4, . . . That is, two lines are added in such a manner as to divide the section between the even-numbered lines which are primarily present in the original image into three portions at even intervals. The image line position shown in FIG. 6 also applies for the odd-numbered fields.

When the image is enlarged a times (a is an arbitrary positive number, which is not 0) in the vertical direction, the position (line number) y of the image line displayed at the m-th display-section line is given by the following equation (1).

$$y=2+(2/a)\cdot(m-1) \tag{1}$$

The value of the image line position (the numeral affixed after the character "L") of each display-section line shown in FIG. 6 conforms to this equation (1). Also, it can be seen that the image line position of each display-section line at the initial size shown in FIG. 5(C) described above can also be obtained by substituting a=1 in equation (1).

The image line positions at the 12th to 15th display lines of FIG. 6, when straight-line interpolation is simply performed by using equation (1), become those shown within parentheses in the figure. However, since it is assumed that the image lines are present only to the 10th line as shown in FIG. 5(A), the lines (the lines L(10+2/3) and L(11+1/3) in FIG. 6) lower than the image line L10 cannot be interpolated in the even-numbered fields. Also, the lines lower than the image line L9 in the odd-numbered fields cannot be interpolated. Accordingly, the image line positions of the 12th to 15th display-section lines of the liquid-crystal display panel 80 are aligned with the image line L9 of the lowest end of the odd-numbered fields. Such adjustment of the image line positions can easily be realized by setting y to its maximum value in a forced manner when the value of y obtained by the above-mentioned equation (1) exceeds the maximum value (9 in the case of FIGS. 5(A), 5(B), and 5(C)) of the image line positions of the odd-numbered fields. As a result of the above, at all the display-section lines, the image line positions of the even-numbered fields and the odd-numbered fields can be made to match with each other. The displaying of the image at different image line positions may be allowed at a small number of lines near the uppermost end or the lowest end in a manner similar to the case of the initial size shown in FIGS. 5(A), 5(B), and 5(C) without performing such readjustment of the value of y. Even if this is done, if the magnification a is not very large, flicker at a small number of lines near the uppermost end or the lowest end is not a problem for practical use.

FIG. 7 is an illustration showing the relationship between the image line position in each display line of the liquid-crystal display panel and the image lines which are primarily contained in the odd-numbered fields and the even-numbered fields. The interpolation coefficient used for an interpolation process for each field is determined from the relationship between the image line position at each display-section line and the position of the image line which is primarily contained in each field. For example, the image line which is provided (displayed) to the second display-section line of the liquid-crystal display panel 80 is L(2+2/3). In the even-numbered fields, the position of this image line L(2+2/3) corresponds to the position which internally divides at a ratio of 1:2 the section between the two image lines L2 and L4. In the odd-numbered fields, the position corresponds to the position which internally divides at a ratio of 5:1 the section between the two image lines L1 and L3.

Here, as shown in FIG. 8, it is assumed that the image line Ly, at which the value of the image line position is y, is interpolated from two image lines $L_i$ and $L_{i+2}$, at which the image line positions are i and (i+2), respectively. This value y is a value obtained from the above-described equation (1). At this time, the line data of the image line Ly is computed based on the following equation (2).

$$Ly=ky\cdot L_i+(1-ky)\cdot L_{i+2} \tag{2}$$

Here, the correction coefficient ky indicates the ratio of the distance between the y line and the (i+2) line to the distance between the i line and the (i+2) line, as shown in the following equation (3).

$$ky=\{(i+2)-y\}/\{(i+2)-i\}=\{(i+2)-y\}/2 \tag{3}$$

The parameter i which indicates the position of the two image lines $L_i$ and $L_{i+2}$ used for interpolation of the image line Ly is given by the following equation (4*a*) at the even-numbered fields.

$$\text{Even-numbered fields: } i=2\cdot\{\text{INT}[y/2]\} \tag{4a}$$

where the operator INT[] indicates an integer-forming computation which discards the decimals of the value within the brackets.

In the odd-numbered fields, the parameter i is given by the following equation (4*b*).

$$\text{Odd-numbered fields: } i=2\cdot\{\text{INT}[(y-1)/2]\}+1 \tag{4b}$$

The line data of the image line provided to the m-th display-section line of the liquid-crystal display panel 80 can be determined from equations (1) to (4*b*) at each of the even-numbered fields and the odd-numbered fields. For example, as shown in FIG. 7, the line data of the image line L(2+2/3) displayed at the second display-section line is computed as described below in the even-numbered fields and the odd-numbered fields, respectively.

$$\text{Even-numbered fields: } L(2+2/3)=2/3\cdot L2+1/3\cdot L4$$

$$\text{Odd-numbered fields: } L(2+2/3)=1/6\cdot L1+5/6\cdot L3$$

FIG. 9 is an illustration showing an image line interpolation equation in the odd-numbered fields and the even-numbered fields which are provided to each display-section line when the image is enlarged three times and displayed. The interpolation coefficients of various image lines are computed from each of the above-described equations (1) to (4*b*).

As described above, when an interlaced original image is to be converted into a non-interlaced one and displayed on the liquid-crystal display panel 80 at a predetermined magnification in the vertical direction, with respect to each display-section line of the liquid-crystal display panel 80, the image line positions provided in the even-numbered fields and the odd-numbered fields, respectively, can be made to match with each other. This makes it possible to prevent occurrence of flicker in the image displayed on the liquid-crystal display panel 80.

D. Interpolation process in the horizontal direction:

The enlargement/reduction process in the horizontal direction can be performed in the same manner as in the case of the vertical direction except that the direction of the enlargement is in the horizontal direction. The pixel position in the horizontal direction of the original image matches between the odd-numbered fields and the even-numbered fields. Therefore, there is no need to make adjustments so that the pixels in the original image of the image data which are respectively provided in the even-numbered fields and in the odd-numbered fields match with each other with respect to each pixel in the horizontal direction of the liquid-crystal display panel 80 as in the enlargement/reduction in the vertical direction.

Hereafter, the pixel within the original image is called an "intra-image pixel", and the pixel position defined within the original image is called an "intra-image pixel position". The value of the intra-image pixel position may be, in addition to an integer, a value including a decimal. Also, the pixels of the liquid-rystal display panel 80 are called "display-section pixels", and the position thereof is called a "display-section pixel position".

When the image is enlarged b times (b is an arbitrary positive number, which is not 0) in the horizontal direction, the position (pixel number) x of the intra-image pixel displayed at the n-th display-section pixel is given by the following equation (5), which is similar to the above-mentioned equation (1).

$$x=1+(1/b)\cdot(n-1) \tag{5}$$

Furthermore, the pixel data of the intra-image pixel Px, whose value of the intra-image pixel position is x, is interpolated from the pixel data of two intra-image pixels $P_j$ and $P_{j+1}$, whose intra-image pixel positions are j and j+1), respectively. At this time, the pixel data of the intra-image pixel Px is computed based on the following equation (6), which is similar to the above-mentioned equation (2).

$$Px=ky\cdot P_j+(1-kx)\cdot P_{j+1} \tag{6}$$

where the correction coefficient kx is given by the following equation (7), which is similar to the above-mentioned equation (3).

$$kx=\{(j+1)-x\}/\{(j+1)-j\}=\{(j+1)-x\} \tag{7}$$

The parameter j which indicates the position of the two intra-image pixels $P_j$ and $P_{j+1}$ used for interpolation of the intra-image pixel Px is given by the following equation (8).

$$j\mathbf{32}\ \{\text{INT}[x]\} \tag{8}$$

In a manner as above, the pixel data of the intra-image pixel provided to the n-th display-section pixel can be determined by using the above-described equations (5) to (7).

E. Interpolation process involved in the enlargement/reduction in the vertical direction and in the horizontal direction:

FIG. 10 is an illustration showing image data of the original image provided to each pixel on each line of the liquid-crystal display panel 80 when the image is enlarged three times in the vertical direction and in the horizontal direction. P(y, x) in the figure indicates pixel data in the x-th intra-image pixel on the y-th image line. x and y, which are parameters indicating the pixel data P(y, x) at the n-th display-section pixel on the m-th display-section line, are computed based on the above-described equations (1) and (5) according to the magnification a in the vertical direction and the magnification b in the horizontal direction, respectively.

The interpolation equation for providing each pixel data can be created by combining an interpolation equation in the vertical direction given by the above-described equation (2) and an interpolation equation in the horizontal direction given by the above-described equation (6). FIG. 11 is an illustration showing a method for interpolating a pixel P(y, x). The correction coefficient ky ($0 \leqq ky \leqq 1$) in the vertical direction is given by the above-described equation (3). Also, the correction coefficient kx ($0 \leqq kx \leqq 1$) in the horizontal direction is given by the above-described equation (7). The x-th pixel data P(y, x) on the y-th image line can be determined on the basis of the following equation (9) from the four pixels P(i, j), P(i, j+1), P(i+2,j), and P(i+2, j+1), which surround the above pixel, and the correction coefficients Ky and Kx.

$$P(y, x)=ky\cdot kx\cdot P(i, j)+ky\cdot(1-kx)\cdot P(i, j+1)+(1-ky)\cdot kx\cdot P(i+2,j)+(1-ky)\cdot(1-kx)\cdot P(i+2,j+1) \quad (9)$$

In equation (9), if kx=1 is set, equation (9) is equivalent to equation (2). That is, based on equation (9), it is also possible to determine the interpolation image data of the y-th image line in the enlargement/reduction of only the vertical direction. In a similar manner, if ky=1 is set, it is also possible to determine the interpolation image data of the x-th pixel in the enlargement/reduction of only the horizontal direction.

Equation (9) can be rewritten into those such as the following equation (10), and (11*a*) to (11*d*).

$$P(y, x)=K00\cdot P(i, j)+K01\cdot P(i, j+1)+K10\cdot P(i+2, j)+K11\cdot P(i+2, j+1) \quad (10)$$

$$K00=ky\cdot kx \quad (11a)$$

$$K01=ky\cdot(1-kx) \quad (11b)$$

$$K10=(1-ky)\cdot kx \quad (11c)$$

$$K00=(1-ky)\cdot(1-kx) \quad (11d)$$

For the interpolation processing circuit 126 shown in FIG. 4, the construction for realizing linear computation of equation (10) is shown. That is, the interpolation processing circuit 126 can create image data which is provided to each pixel on each line of the liquid-crystal display panel 80 in a predetermined enlargement/reduction process according to the setting of the four coefficients K00, K01, K10, and K11.

FIGS. 12(A) and 12(B) are illustrations showing coefficients K00, K01, K10, and K11 used when the image is enlarged three times in the vertical direction and in the horizontal direction. The lines and the pixels in the figure indicate the lines (display-section lines) and the pixels (display-section pixels), respectively, of the liquid-crystal display panel 80. The parameters i and j indicating the four pixels P(i, j), P(i, j+1), P(i+2, j), and P(i+2, j+1) which are used to correct the n-th pixel of the m-th display-section line are determined based on the above-described equations (1), (4*a*) and (4*b*) in the even-numbered fields. Also, in the odd-numbered fields, the parameters are determined based on the above-described equations (5) and (8). Furthermore, the values of the four coefficients K00, K01, K10, and K11 are computed based on the above-described equations (3), (7), and (11*a*) to (11*d*).

FIGS. 13(A) and 13(B) are illustrations showing coefficients K00, K01, K10, and K11 used when the image is enlarged 5/4 times in the vertical direction and in the horizontal direction. The lines and the pixels in the figure indicate the lines and the pixels, respectively, of the liquid-crystal display panel 80. In a manner similar to the case of the three-times enlargement, also in the case in which the image is enlarged 5/4 times and displayed, by interpolating each pixel based on the above-described equations (1) to (11d), it is possible to provide pixel data at the same pixel position within the original image to the same pixel of the liquid-crystal display panel 80 in either the even-numbered fields or the odd-numbered fields. As a result, occurrence of flicker can be prevented.

As has been described as above, the image processing apparatus of the present invention displays the image stored in the field memory 110 (FIG. 2) at a desired magnification and can prevent flicker at this time.

The above-described embodiment is described by using, as an example, a case in which an image is enlarged at an equal magnification in the vertical direction and in the horizontal direction. However, the magnification b in the horizontal direction and the magnification a in the vertical direction can be set to be arbitrary positive values which are not 0 and are independent of each other. Furthermore, in addition to the case of enlargement, the magnification may also be applied to the case of reduction.

In the present invention, when the magnification a in the vertical direction of the image is an even number, the same result as that of the case of the straight-line interpolation can be obtained for both the odd-numbered fields and the even-numbered fields. Therefore, the present invention has advantages, in particular, when the magnification b in the vertical direction of the image is a value other than an even number (for example, 1/3, 5/4, 3, 5, etc.).

Also, in the above-described embodiment, as the interpolation processing circuit 126, a matrix computation circuit of two rows and two columns for realizing equation (10) is shown as an example. However, the interpolation processing circuit 126 is not limited to this example.

A filter by higher-order matrix computation may also be used. Furthermore, an interpolation computation circuit by a spline or a Bezier curve may also be used. For example, when data of a line between two lines is to be interpolated, it is determined whether the image between these two lines is upwards convex or downwards convex from the data of the adjacent upper and lower lines. It is also possible that the correction coefficients are appropriately converted according to this determination result. As a result of the above, interpolation with higher accuracy can be performed.

This invention is not limited to the above-described embodiments and the mode of working, and may be embodied in various modes without departing from the spirit and scope of the present invention. For example, a modification such as that described below is possible.

In the above-described embodiment, as a light modulation section, a liquid-crystal panel is used. In addition, as the light modulation section, various apparatuses which generate light from which an image can be visually recognized may be used. For example, a reflection-type light valve, such as DMD (Digital Micromirror Device: trademark of TI), a light-emission-type display apparatus using EL (Electro-Luminescence) or LED, a plasma display panel, a CRT, etc. may be used as a light modulation section. The liquid-crystal panel is a light modulation unit in a narrow sense which modulates light supplied from a light source in accordance with an image signal, while EL devices, LEDs, a plasma display panel, and a CRT may be considered to have both the function of a light source and the function of a light modulation unit in a narrow sense.

What is claimed is:

1. An image processing method for supplying, by a non-interlace method, image signals to a light modulation section in accordance with two field image signals displaying the odd-nimbered line fields and the even-numbered line fields of an original image by an interlace method, the image processing method comprising the steps of:

generating two image signals for display to be alternately provided to the light modulation section from the two field image signals, respectively, in order to alternately supply, by a non-interlace method, the image signals representing the two images, in which two field images represented by the two field image signals are each enlarged a times in the vertical direction, to the light modulation section; and interpolating at least one of the two field image signals so that the two image signals for display generated on the respective two field image signals, which are alternatively provided to the same line of the light modulation section, indicate the image at mutually equal line positions defined within the original image.

2. The image processing method according to claim 1, further comprising the steps of:

generating, when the two field images are each enlarged b times in the horizontal direction, an image signal representing a target pixel, which is a pixel on each line of the light modulation section, by performing interpolation, in odd-numbered line fields and in the even-numbered line fields, on a respective four pixels contained in the odd-numbered line fields and the even-numbered line fields in the original image; and selecting four closest pixels which surround the target pixel in a lattice form as the four pixels.

3. The image processing method according to claim 1, wherein the light modulation section is a liquid crystal panel.

4. The image processing method according to claim 1, wherien the light modulation section is a plasma display panel.

5. The image processing method according to claim 1, wherein the light modulation section is a cathode-ray tube (CRT).

6. The image processing method according to claim 1, wherein the interpolating step is performed using matrix-computation.

7. The image processing method according to claim 1, wherein the interpolating step is performed using a spline.

8. The image processing method according to claim 1, wherein the interpolating step is performed using a Bezier curve.

9. An image display apparatus for supplying, by a non-interlace method, image signals to a light modulation section in accordance with two field image signals for displaying the odd-numbered line fields and the even-numbered line fields of an original image by an interlace method, the image display apparatus comprising:

an image processing section that alternately supplies image signals representing two images by a non-interlace method, in which two field images represented by the two field image signals are each enlarged a times in the vertical direction, to the light modulation section, to generate two image signals for display to be alternately provided to the light modulation section from the two field image signals, respectively; and an interpolation section that interpolates at least one of the two field image signals so that the two image signals for display generated based on the respective two field image signals, which are alternately provided to the same line of the light modulation section, indicate the image at mutually equal line positions defined within the original image.

10. The image display apparatus according to claim 9, wherein the image processing section, when the two field images are each enlarged b times in the horizontal direction, generates an image signal representing a target pixel, which is a pixel on each line of the light modulation section, by performing interpolation using the interpolation section, in the odd-numbered line fields and in the even-numbered line fields, on respective four pixels contained in the odd-numbered line fields and the even-numbered line fields in the original image, and selects four closest pixels which surround the target pixel in a lattice form, as the four pixels.

11. The image display apparatus according to claim 9, wherein the light modulation section is a liquid crystal panel.

12. The image display apparatus according to claim 9, wherein the light modulation section is a plasma display panel.

13. The image display apparatus according to claim 9, wherein the light modulation section is a cathode-ray tube (CRT).

14. The image display apparatus according to claim 9, wherein the interpolating interpolates using matrix-computation.

15. The image display apparatus according to claim 9, wherein the interpolating section interpolates using a spline.

16. The image display apparatus according to claim 9, wherein the interpolating section interpolates using a Bezier curve.

* * * * *